US006344827B1

(12) United States Patent
Wu

(10) Patent No.: US 6,344,827 B1
(45) Date of Patent: Feb. 5, 2002

(54) DUAL-FREQUENCY ANTENNA FOR MOBILE PHONE

(75) Inventor: Mao-Sung Wu, Taoyuan (TW)

(73) Assignee: Senton Enterprise Co., Ltd., Pa Te (TW)

( * ) Notice: Subject to any disclaimer, the term of this patent is extended or adjusted under 35 U.S.C. 154(b) by 0 days.

(21) Appl. No.: 09/739,819

(22) Filed: Dec. 20, 2000

(51) Int. Cl.[7] ..... H01Q 1/24
(52) U.S. Cl. ..... 343/702; 343/895
(58) Field of Search ..... 343/702, 866, 343/867, 872, 895, 906; H01Q 1/24, 1/36

(56) References Cited

U.S. PATENT DOCUMENTS 5,349,365 A * 9/1994 Ow et al. ..... 343/895
5,467,096 A * 11/1995 Takamoro et al. ..... 343/702
5,825,334 A * 10/1998 Gherardini et al. ..... 343/830
6,002,371 A * 12/1999 Mittler et al. ..... 343/702
6,005,523 A * 12/1999 Rudisill ..... 343/702
6,130,651 A * 10/2000 Yanagisawa et al. ..... 343/895
6,225,953 B1 * 5/2001 Kamei et al. ..... 343/702

* cited by examiner

*Primary Examiner*—Tho G. Pham
(74) *Attorney, Agent, or Firm*—Birch, Stewart, Kolasch & Birch, LLP

(57) ABSTRACT

A dual-frequency antenna for mobile phone includes an integrally stamped thin metal conductor to function as a frequency-control structure of the antenna. An upper end of the stamped thin metal conductor is a curved wave coil and a lower end thereof is a connector having two hooks. The curved wave coil includes horizontal and vertical wave segments adapted to two different frequencies of 900 MHz and 1800 MHz, respectively. A cover encloses the curved wave coil to protect the coil against impact and deformation. The connector is adapted to insert into an antenna jack on a mobile phone to contact with a conductive leaf spring in the mobile phone, and the two hooks of the connector are adapted to firmly hold the whole antenna to the mobile phone.

3 Claims, 6 Drawing Sheets

DUAL-FREQUENCY ANTENNA FOR MOBILE PHONE

BACKGROUND OF THE INVENTION

The present invention relates to a dual-frequency antenna for mobile phone, and more particularly to a dual-frequency antenna formed from an integrally stamped thin metal conductor to enable quick connection of the antenna at a lower connector to a mobile phone and accurate controlling of the antenna frequencies.

FIGS. 1 and 2 are exploded and assembled perspective views, respectively, of a conventional antenna for mobile phone. The conventional antenna for mobile phone mainly includes two spring coils 10, 20 having large and small coil sizes, respectively, for putting around outer and inner wall surfaces, respectively, of a hollow insulting sleeve 30, and a link 40 connected to a bottom of the sleeve 30. The sleeve 30 is then covered with a protective casing (not shown). Through frequency matching and selection for the two spring coils 10, 20 at outer and inner sides of the insulating sleeve 30, the antenna is adapted to use with a dual-frequency mobile phone.

The spring coils 10, 20 are usually ready-made products. They are manufactured by winding wires around dies and manually adjusting the dies from time to time for the resultant spring coils 10, 20 to meet required specifications, including wire gauge for forming the spring coil, the coil size, the coil spacing, and the length of the coil. It is possible to effectively control such specifications when there is only a small quantity of spring coils to be produced through a die. However, when a large quantity of spring coils 10, 20 are produced, there would be difference in the specifications of the spring coils 10, 20 produced in different batches due to offset or deformation of dies having been used for a long time and some factors that could not be fully overcome in the manufacturing process. Spring coils 10, 20 that do not uniformly meet all the required specifications would inevitably adversely affect the accuracy of the antenna frequency. Moreover, the spring coils 10, 20 tend to compress and tangle with one another and become deformed during packing and transportation. The spring coils are subject to deformed coil spacing when an operator careless pulls the spring coils, making the antenna using these deformed coil springs failed to match the selected frequencies and resulted in poor signal receiving. The conventional antenna for mobile phone also includes complicate components and requires multiple steps to assemble the antenna and therefore need higher manufacturing costs.

SUMMARY OF THE INVENTION

It is therefore a primary object of the present invention to provide a dual-frequency antenna for mobile phone in which an integrally stamped thin metal conductor is included to function as a frequency-control structure of the antenna. An upper end of the stamped thin metal conductor is a curved wave coil and a lower end thereof is a connector having two hooks. The curved wave coil includes horizontal and vertical wave segments adapted to two different frequencies of 900 MHz and 1800 MHz, respectively. A cover encloses the curved wave coil to protect the coil against impact and deformation. The connector is adapted to insert into an antenna jack on a mobile phone to contact with a conductive leaf spring in the mobile phone, and the two hooks of the connector are adapted to firmly hold the whole antenna to the mobile phone.

Another object of the present invention is to provide a dual-frequency antenna that could be quickly and removably connected to a mobile phone. The antenna has a main body made of an integrally stamped thin metal conductor. A lower end of the main body forms a connector having two hooks provided at two sides thereof and two resilient pressing plates located above the two hooks and partially exposed from holes provided on a cover closing the main body. When the antenna is connected to a mobile phone, the two hooks abut against an inner wall of the mobile phone and hold the antenna to the phone. By depressing the two pressing plates, the two hooks are radially inward moved to separate from the inner wall of the mobile phone and thereby allow removal of the antenna from the mobile phone easily.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
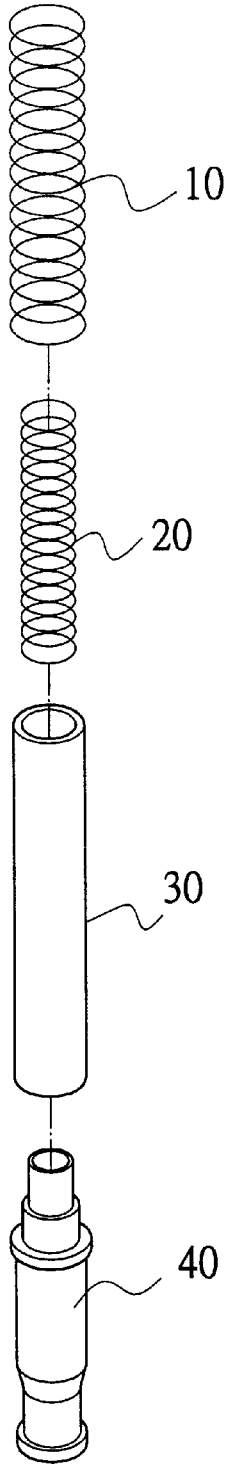
(PRIOR ART) Fig.1
FIG. 1 is an exploded perspective of a conventional dual-frequency antenna for mobile phone.
Figure 2:
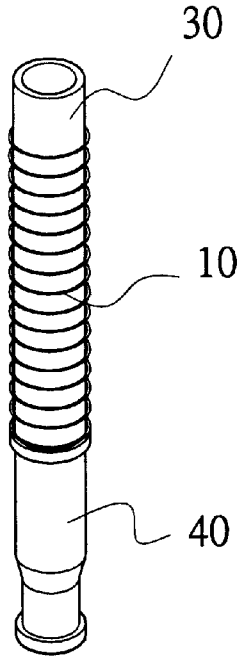
(PRIOR ART) Fig.2
FIG. 2 is an assembled perspective of the conventional dual-frequency antenna of FIG. 1.
Figure 3:
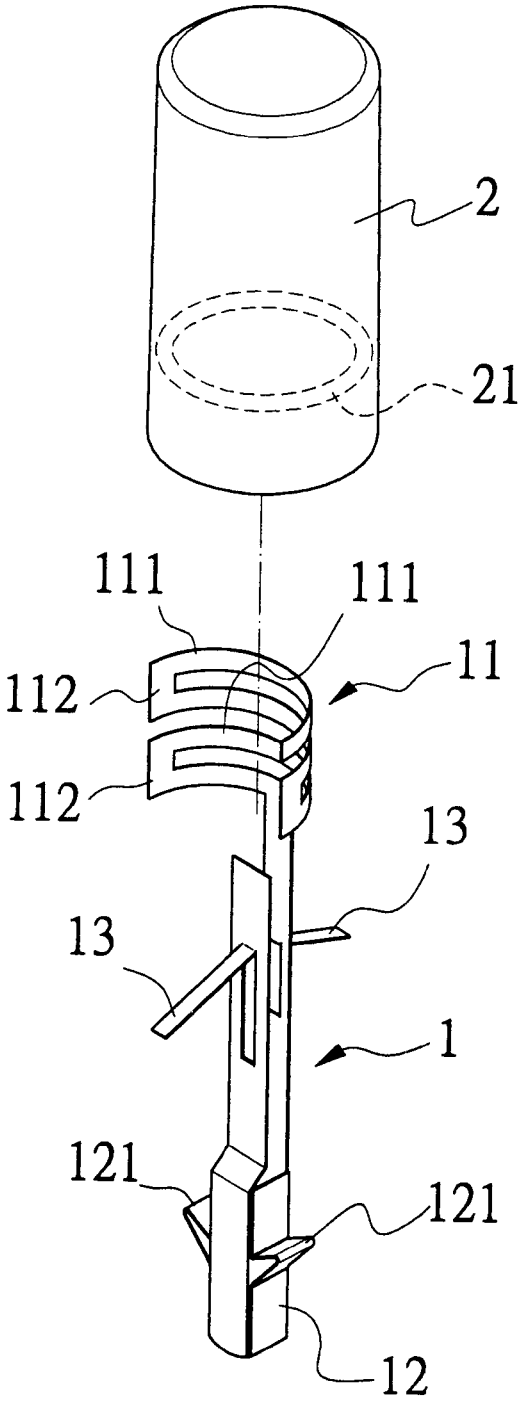
FIG. 3 is an exploded perspective of a dual-frequency antenna for mobile phone according to the present invention.

Please refer to FIG. 3 that is an exploded perspective of a dual-frequency antenna for mobile phone according to a first embodiment of the present invention. As shown, the antenna mainly includes a main body 1 and a cover 2.

The main body 1 is made of a thin metal conductor that is integrally stamped into a desired shape to include a curved wave coil 11 at an upper end thereof and a connector 12 at a lower end thereof. The curved wave coil 11 includes horizontal wave segments 111 and vertical wave segments 112 adapted to two different frequencies of 900 MHz and 1800 MHz, respectively. A portion of the main body 1 between the wave coil 11 and the connector 12 is stamped at two sides to provide two downward and outward extended arms 13. The connector 12 is formed at two sides with two hooks 121.

The cover 2 is made of an insulating plastic material. A curvature of an inner wall of the cover 2 matches with that of the curved wave coil 11. A radially inward projected stop ring 21 is provided around the inner wall of the cover 2 at a predetermined position.

Figure 4:
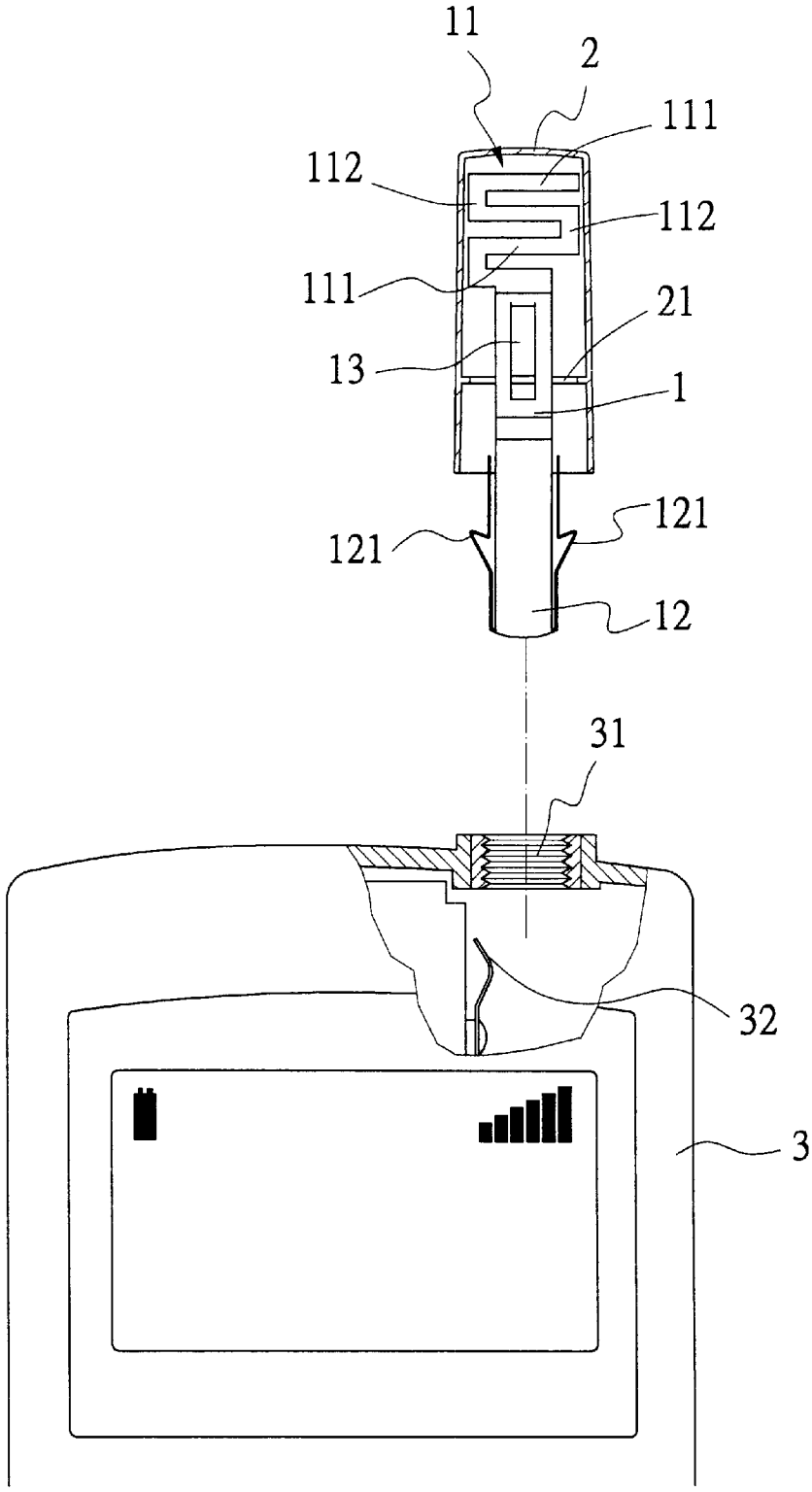
FIG. 4 is an assembled sectional view of the dual-frequency antenna of FIG. 3 before connecting to a mobile phone.
Figure 5:
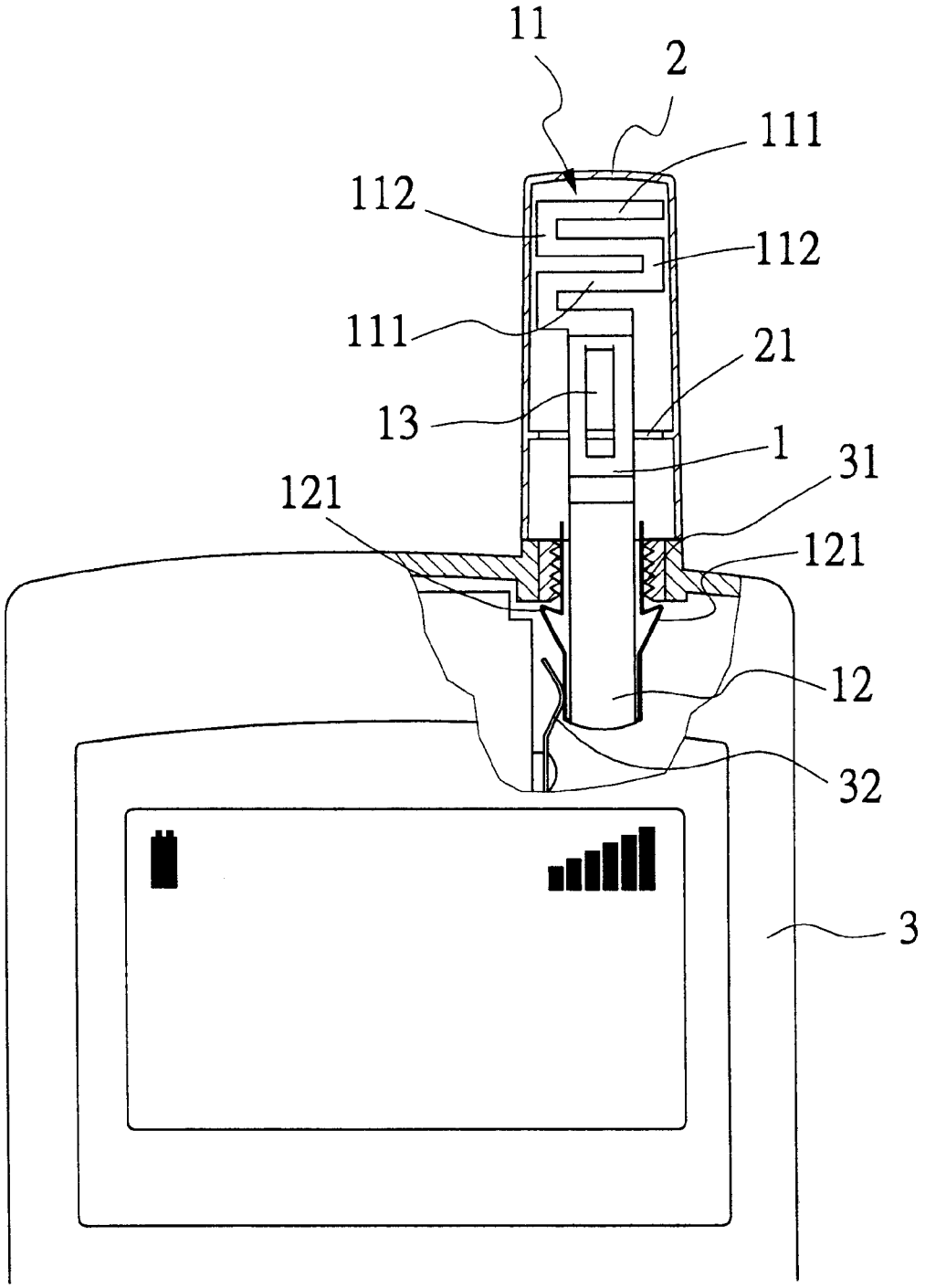
FIG. 5 is an assembled sectional view of the dual-frequency antenna of FIG. 3 having been connected to a mobile phone.

Please refer to FIGS. 4 and 5. In assembling the antenna of the present invention to a mobile phone 3, the main body 1 is forward extended into the cover 2 from a bottom opening of the cover 2, so that the curved wave coil 11 at the upper end of the main body 1 passes the stop ring 21 to locate in the cover 2 and the two arms 13 resiliently press their lower ends against an upper surface of the stop ring 21, enabling the main body 1 to firmly associate with the cover 2. The cover 2 protects the curved wave coil 11 therein against impact and deformation. Thereafter, the connector 12 at the lower end of the main body 1 is inserted into an antenna jack 31 provided on the mobile phone 3 until the two hooks 121 pass the antenna jack 31 to abut against an inner wall of the mobile phone 3 and prevent the whole antenna from moving back out of the antenna jack 31. At this point, the connector 12 contacts with a conductive leaf spring 32 provided in the mobile phone 3 to quickly complete the assembling of the antenna to the mobile phone 3 and enable the mobile phone 3 to accurately receive signals of any one of two different frequencies of 900 MHz and 1800 MHz.

Figure 6:
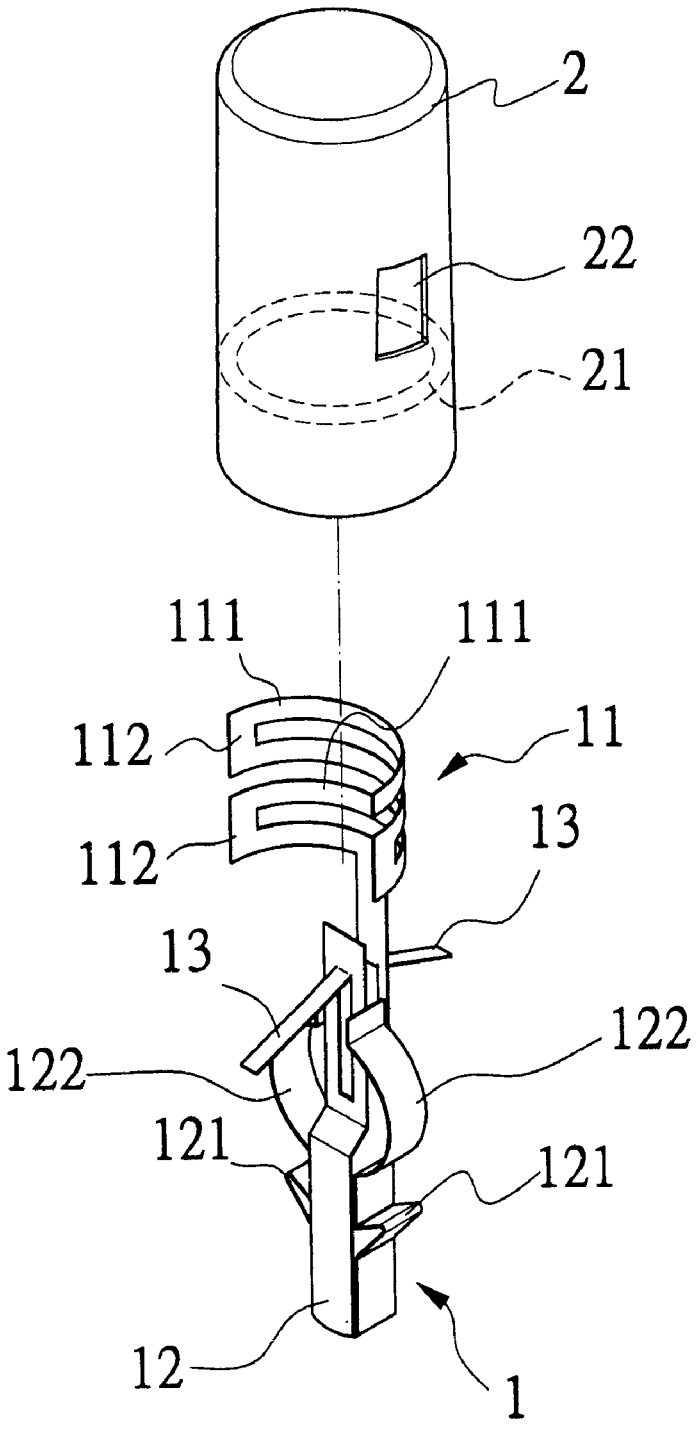
FIG. 6 is an exploded perspective of a dual-frequency antenna for mobile phone according to another embodiment of the present invention.
Figure 7:
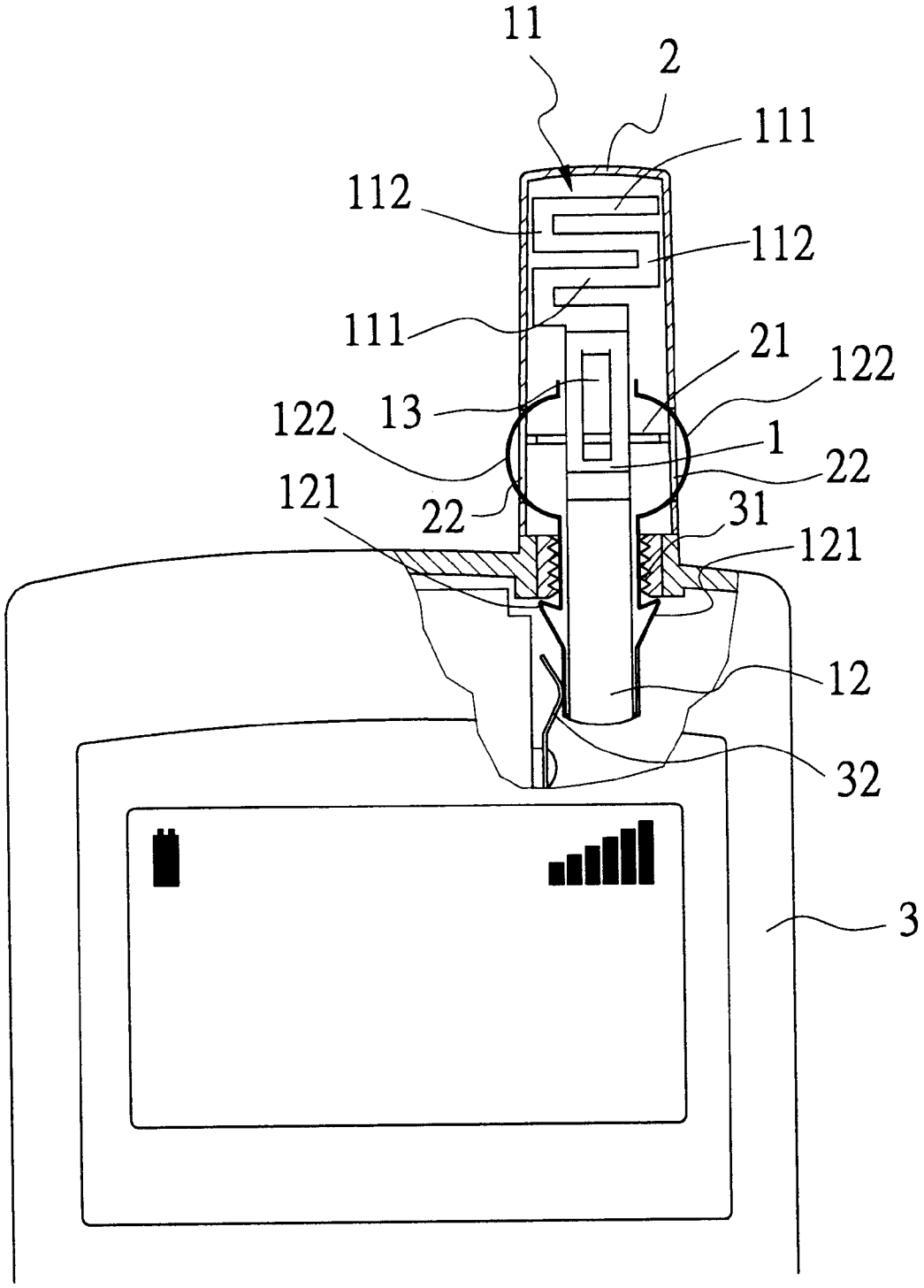
FIG. 7 is an assembled sectional view of the dual-frequency antenna of FIG. 6 having been connected to a mobile phone.

Please now refer to FIGS. 6 and 7 in which a dual-frequency antenna for mobile phone according to another embodiment of the present invention is shown. In this embodiment, the antenna further includes two pressing plates 122 provided above the two hooks 121 of the connector 12 also through stamping, so that the two pressing plates 122 are portions integrally extended from the hooks 121. Meanwhile, the cover 2 is also provided on its wall with two diametrically opposite holes 22 corresponding to the two pressing plates 122, so that the pressing plates 122 partially expose from the holes 22 after the main body 1 is inserted into the cover 2. When the antenna of this second embodiment of the present invention is assembled to the mobile phone 3, it could be quickly removed from the mobile phone 3 simply by applying a force on the two exposed pressing plates 122 to cause the two hooks 121 to move radially inward and separate from the jack 31. This design enables the antenna of the present invention to meet the requirement of some mobile phone manufacturers for an antenna to removably mount on the mobile phone 3.

What is claimed is:

1. A dual-frequency antenna for mobile phone, comprising a main body and a cover;

said main body being made of a thin metal conductor that is integrally stamped into a desired shape to include a curved wave coil at an upper end and a connector at a lower end of said main body, a portion of said main body between said wave coil and said connector being stamped at two sides to provide two downward and outward extended arms, and said connector being formed at two sides with two hooks; and said cover being made of an insulating plastic material, a curvature of an inner wall of said cover matching with that of said curved wave coil, and a radially inward projected stop ring being provided around the inner wall of said cover at a predetermined position;

said main body being positioned in said cover from a bottom opening of said cover, such that said curved wave coil at the upper end of said main body is located in said cover and said two arms at two sides of said main body pass said stop ring to resiliently press against an upper surface of said stop ring; and said connector at the lower end of said main body being adapted to insert into an antenna jack provided on a mobile phone to contact with a conductive leaf spring provided in said mobile phone for said mobile phone to accurately receive signals, and said two hooks provided at two sides of said connector being adapted to pass said antenna jack and abut against an inner wall of said mobile phone to prevent said main body from moving back out of said antenna jack and accordingly said mobile phone.

2. A dual-frequency antenna for mobile phone as claimed in claim 1, wherein said curved wave coil includes horizontal wave segments and vertical wave segments adapted to two different frequencies of 900 MHz and 1800 MHz, respectively.

3. A dual-frequency antenna for mobile phone as claimed in claim 1, further comprises two pressing plates formed above said two hooks at two sides of said connector by stamping portions of said connector integrally extended from said hooks, and two holes formed on said cover corresponding to said two pressing plates for said two pressing plates to partially expose from said two holes.

* * * * *